US009186535B2

(12) United States Patent
Ercanbrack

(10) Patent No.: US 9,186,535 B2
(45) Date of Patent: Nov. 17, 2015

(54) SYSTEM AND METHOD FOR ADJUSTING LENGTH OF A CORD

(71) Applicant: ICON Health and Fitness, Inc., Logan, UT (US)

(72) Inventor: Gaylen Ercanbrack, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 267 days.

(21) Appl. No.: 13/838,377

(22) Filed: Mar. 15, 2013

(65) Prior Publication Data

US 2014/0274604 A1 Sep. 18, 2014

(51) Int. Cl.

| | |
|---|---|
| ***A63B 21/04*** | (2006.01) |
| ***A63B 21/055*** | (2006.01) |
| ***A63B 21/00*** | (2006.01) |
| ***B65H 75/10*** | (2006.01) |
| ***B65H 75/28*** | (2006.01) |

(52) U.S. Cl.

CPC ..... *A63B 21/0557* (2013.01); *A63B 21/00069* (2013.01); *A63B 21/0442* (2013.01); *A63B 21/0552* (2013.01); *A63B 21/1446* (2013.01); *A63B 21/1465* (2013.01); *B65H 75/10* (2013.01); *B65H 75/28* (2013.01); *A63B 21/00185* (2013.01); *A63B 21/1469* (2013.01); *Y10T 24/37* (2015.01); *Y10T 29/49826* (2015.01)

(58) Field of Classification Search

CPC ..... A63B 21/0552; A63B 21/0557; A63B 21/055; A63B 21/0442; A63B 21/1446; A63B 21/00069; A63B 21/00158; A63B 21/1469; Y10T 29/49826; Y10T 24/37; B65H 75/36; B65H 75/364; B65H 75/10; B65H 75/28; E04B 1/1903; E04B 1/1906; E04B 1/1909; E04B 1/1912; A04B 2001/2406; A04B 2001/2409; A04B 2001/2415; A04B 2001/2439; A04B 2001/264; A04B 2001/2692

USPC ..... 242/388.9, 405, 405.1, 407, 577, 588.2, 242/600, 613, 613.1, 388.2, 388, 3.881, 242/613.3

See application file for complete search history.

(56) References Cited

U.S. PATENT DOCUMENTS

| | | | | | |
|---|---|---|---|---|---|
| 571,761 | A * | 11/1896 | Gulliford | F16G 11/00 | 24/129 A |
| 1,579,886 | A * | 4/1926 | Oxner | 242/396.5 | |
| 2,533,341 | A * | 12/1950 | Alfano | H02G 11/02 | 24/129 R |
| 2,587,707 | A * | 3/1952 | Dever | 242/388 | |
| 3,924,819 | A * | 12/1975 | Lapinskas | B65H 75/36 | 242/388 |
| 4,938,432 | A * | 7/1990 | Kurt | B65H 75/28 | 242/125.1 |
| 5,109,577 | A * | 5/1992 | Young | 242/388 | |
| 6,142,405 | A * | 11/2000 | Black | B65H 75/06 | 242/388.6 |
| 6,676,576 | B1 * | 1/2004 | Wu | 482/126 | |
| 7,229,043 | B2 * | 6/2007 | Pitcher | B65H 75/143 | 242/388.2 |
| 7,487,932 | B2 * | 2/2009 | Ellis | B65H 75/148 | 242/125.2 |
| 7,661,623 | B2 * | 2/2010 | Peng | B65H 75/04 | 242/118.4 |
| 8,012,071 | B2 * | 9/2011 | Grisdale | 482/122 | |
| 2005/0075223 | A1 * | 4/2005 | Wu | 482/126 | |
| 2014/0283339 | A1 * | 9/2014 | Gallagher | F16G 11/046 | 24/115 K |

* cited by examiner

*Primary Examiner* — Loan H Thanh
*Assistant Examiner* — Megan Anderson
(74) *Attorney, Agent, or Firm* — Holland & Hart LLP

(57) ABSTRACT

A device for adjusting a length of a cord is disclosed. The device may include a body portion having a channel defined by first and second opposed walls shaped to receive a cord. Each of the first wall and the second wall may include at least one notch shaped to receive the cord in a direction provided at an angle to the channel.

19 Claims, 6 Drawing Sheets

SYSTEM AND METHOD FOR ADJUSTING LENGTH OF A CORD

FIELD OF THE DISCLOSURE

The present disclosure generally relates to exercise equipment and, more particularly, relates to devices and methods for adjusting lengths of exercises equipment, such as, resistance bands.

BACKGROUND OF THE DISCLOSURE

In order to maintain good health, an exercise regimen has become an integral part of many daily routines. Examples literally run the gamut of physical activity, from running, walking and swimming, to weight lifting and resistance training, to yoga and martial arts, to name but a few. Depending upon the health, body image, and overall exercise goals of an individual, a certain exercise regimen employing some or all of the above or other type of exercises(s) can be performed at regular intervals.

Resistance band exercises that use a resistance band for performing resistance exercises, such as, squats, lunges, chest presses, etc., are becoming increasingly popular. A resistance band can generally be described as a tensioned flexible tubing or solid cord. Resistance bands are now widely used by fitness trainers for training various muscle groups within the body and for improving/maintaining general body strength of their clients. Resistance band exercises are also gaining popularity among health professionals for injury prevention or rehabilitation.

At least in part, the popularity of the resistance band stems from the fact that it is an inexpensive and a versatile piece of exercise equipment that can be employed for performing a variety of exercises by users of all fitness levels and it can also be employed in targeting smaller groups of muscles that may be hard to train with more traditional free weight exercises. Furthermore, given that a resistance band is compact and lightweight, it can be easily transported from one place to another for performing exercises anywhere on the go (e.g., in the car, office, etc.). Exercises using a resistance band can even be incorporated in home exercise regimens.

Thus, given this wide acceptability of resistance bands and resistance band exercises, a variety of resistance bands are now available in the market. To effectively utilize the resistance band for a particular group of exercises and to prevent injury, the length of the band needs to be appropriate for the desired exercise. Users may, therefore, own multiple resistance bands of varying lengths to perform different groups of exercises. However, owning multiple resistance bands not only adds to the overall cost of performing resistance band based exercises, but also impacts the portability of those bands. Users may not be able or willing to carry multiple bands, which may dissuade them from performing exercises outside of their traditional exercise area.

The usable length of a resistance band also varies depending upon the height of a person. Furthermore, owing to the varying lengths of the resistance bands, resistance bands may not be easily shared between persons of varying heights within a single household.

Accordingly, it would be beneficial if a system for adjusting the length of a resistance band is developed, such that a single band can be utilized for performing a variety of resistance band exercises by users of varying heights. It would additionally be beneficial if such a system did not impact the portability of the resistance band significantly.

SUMMARY OF THE DISCLOSURE

In accordance with at least one aspect of the present disclosure, a device for adjusting a length of a cord is disclosed. The device may include a body portion having a channel defined by first and second opposed walls shaped to receive a cord. Each of the first wall and the second wall may include at least one notch shaped to receive the cord in a direction provided at an angle to the channel.

In another aspect, which may be combined with one or more other aspects, the device may include a smallest diameter at a lateral center and a largest diameter at first and second ends flanking the lateral center.

In another aspect, which may be combined with one or more other aspects, the first wall, the second wall and the body portion may be integrally formed.

In another aspect, which may be combined with one or more other aspects, the device may be elastic or rigid.

In another aspect, which may be combined with one or more other aspects, the first wall and the second wall may each include at least one ear or optionally a pair of ears defining the at least one notch in each wall.

In another aspect, which may be combined with one or more other aspects, at least one notch in the first wall and the at least one notch in the second wall may be substantially parallel.

In another aspect, which may be combined with one or more other aspects, the channel may include a longitudinal axis and each of the at least one notch may include a longitudinal axis, such that the longitudinal axis of the channel may be substantially perpendicular to each of the longitudinal axes of the at least one notch.

In another aspect, which may be combined with one or more other aspects, the device may be an exercise resistance band.

In another aspect, which may be combined with one or more other aspects, a method for adjusting a length of a resistance band is disclosed. The method may include providing a resistance band and a length adjustment device, the length adjustment device may have a channel defined by first and second opposed walls, each of the first wall and the second walls may further include at least one notch. The method may further include threading in one end of the resistance band through one of the at least one notch and wrapping a portion of the threaded resistance band around the length adjustment device. The method may additionally include threading out the resistance band through the other of the at least one notch.

In another aspect, which may be combined with one or more other aspects, each of the at least one notch may form ears in the length adjustment device, the band engaging the ears so as to permit axial loading of the band without disengaging the band from the length adjustment device.

In another aspect, which may be combined with one or more other aspects, the length adjustment device may also permit wrapping at least two feet of the resistance band around the length adjustment device.

In another aspect, which may be combined with one or more other aspects, threading in of the resistance band may include positioning one end of the resistance band into the channel and turning the one end of the resistance band from the channel substantially ninety degrees into the one of the at least one notch.

In another aspect, which may be combined with one or more other aspects, threading out the resistance band may include wrapping a first coil of the resistance band circumferentially around the length adjustment device and into the other of the at least one notch and turning the resistance band from the other of the at least one notch substantially ninety degrees to fix the length of the resistance band.

In another aspect, which may be combined with one or more other aspects, the method may additionally include adjusting the length of the resistance band by unthreading one end of the resistance band from one of the at least one notch, wrapping or unwrapping one or more coils of the resistance band around the length adjustment device and rethreading the resistance band through the one of the at least one notch.

In another aspect, which may be combined with one or more other aspects, an exercise equipment for facilitating resistance band exercises is disclosed. The exercise equipment may include a length adjustment device having a channel defined by a first wall and a second wall, with each of the first wall and the second wall having at least one notch provided at an angle. The exercise equipment may also include a resistance band adapted to be engaged relative to the length adjustment device and secured at various lengths thereof.

In another aspect, which may be combined with one or more other aspects, the length adjustment device may permit performing multiple exercises using a single resistance band by adjusting a length of the resistance band.

In another aspect, which may be combined with one or more other aspects, the length adjustment device may have broader end portions compared to a middle portion thereof to dissuade the resistance band from becoming disengaged.

In another aspect, which may be combined with one or more other aspects, the length of the resistance band may be adjusted by wrapping the band around the length adjustment device to a desired number of coils and securing the resistance band through the at least one notch.

BRIEF DESCRIPTION OF THE DRAWINGS

For a more complete understanding of the disclosed methods and apparatuses, reference should be made to the embodiments illustrated in greater detail on the accompanying drawings, wherein.

DETAILED DESCRIPTION OF THE DISCLOSURE

Figure 1:
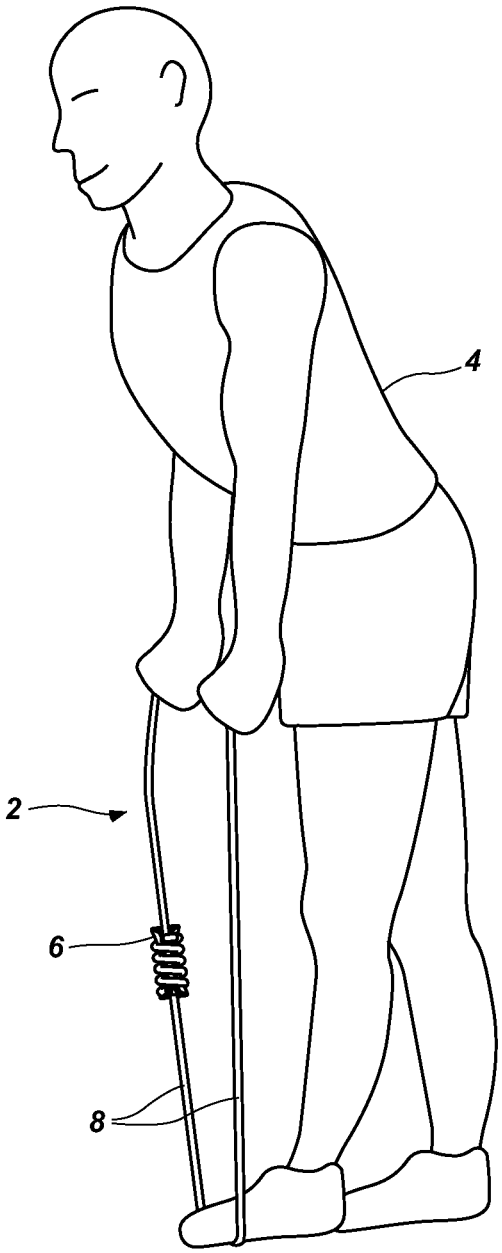
FIG. 1 is a schematic illustration of a user performing an exemplary exercise using exercise equipment constructed in accordance with the teachings of the disclosure and having a length adjustment device engaging a cord.

Referring to FIG. 1, an exercise equipment 2 in use by a user 4 is shown, in accordance with at least some embodiments of the present disclosure. As illustrated, the exercise equipment 2 may include a length adjustment device 6 having a cord or band 8 wrapped there around for adjusting the length of the cord or band 8. As will be described further below, by virtue of adjusting the length of the cord 8, the exercise equipment 2 may be used by a plurality of users of varying heights and builds to perform a variety of exercises, only one form of which is shown in FIG. 1. As will also be described below, the cord 8, in at least some embodiments, may be an exercise resistance band flanked on both ends by a handle (used by the user 4 to grip the resistance band). In other embodiments, the cord 8 may be any of a wide variety cords that may be employed for performing exercises, with or without handles.

Furthermore, notwithstanding the fact that the length adjustment device 6 and the cord 8 in the present embodiment have been described with respect to exercise equipment, the present length adjustment device may be employed in any application that needs length adjustment of a cord and in conjunction with any type of cord suitable for that application.

Figure 3:
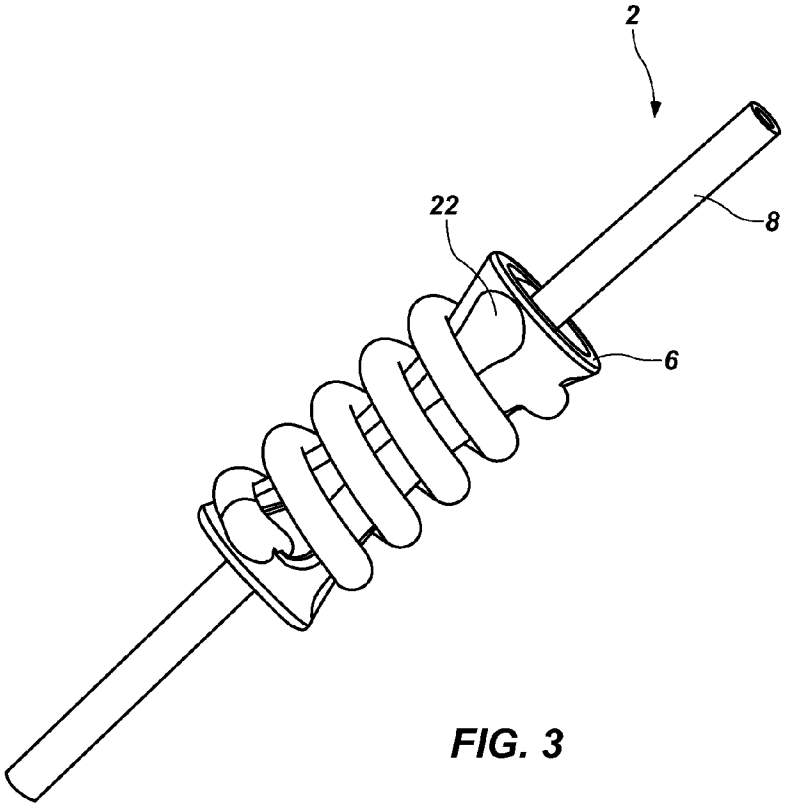
FIG. 3 is a perspective view of the device of FIG. 2.
Figure 2:
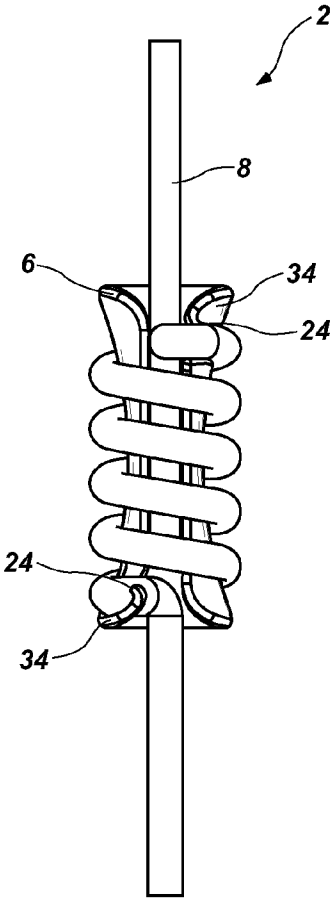
FIG. 2 is a front view of the length adjusting device of FIG. 1 with the cord wrapped there around, in accordance with at least some embodiments of the present disclosure.

Referring now to FIGS. 2 and 3, front and perspective views, respectively, of the length adjustment device 6 with the cord 8 wrapped there around are shown, in accordance with at least some embodiments of the present disclosure. The length adjustment device 6 is further discussed below with respect to FIGS. 4-6 and the manner of wrapping the cord 8 around the length adjustment device 6 is discussed in greater detail with respect to FIG. 7.

Figure 6:
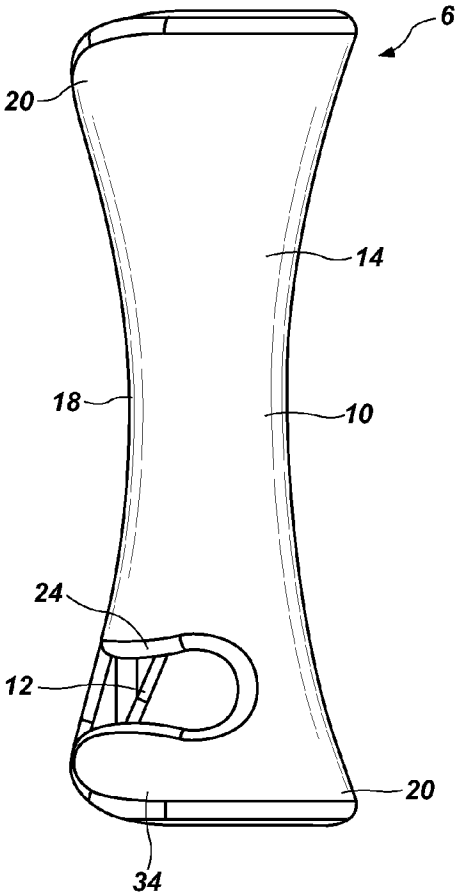
FIG. 6 is a side view of the device of FIG. 4.
Figure 5:
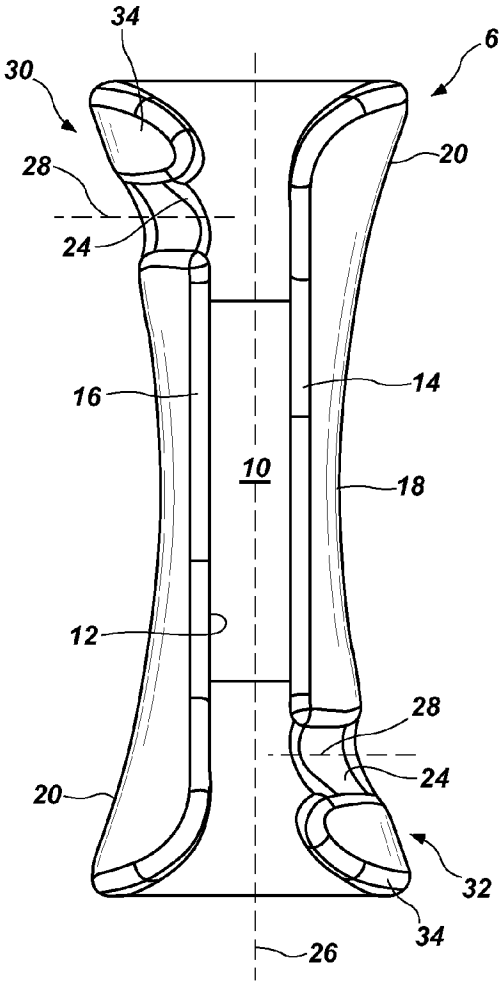
FIG. 5 is a front view of the device of FIG. 4.
Figure 4:
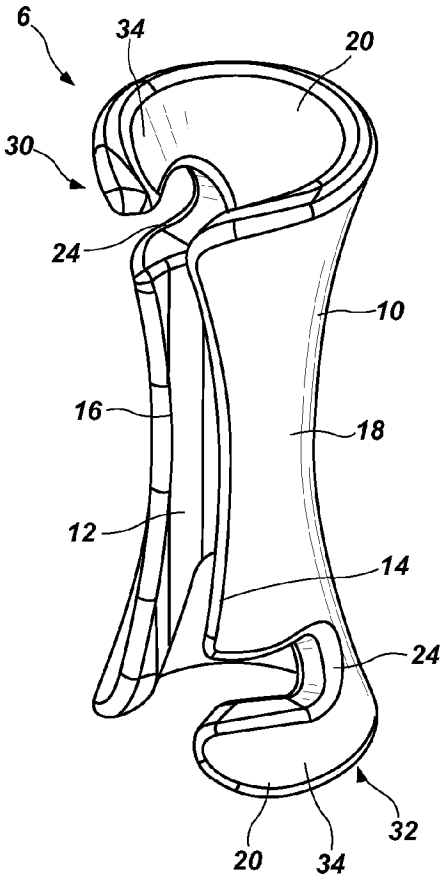
FIG. 4 is a perspective view of the length adjusting device of FIG. 1 without a cord wrapped there around and constructed in accordance with at least some teachings of the present disclosure.

Referring now to FIGS. 4-6 in conjunction with FIGS. 2 and 3, various views of the length adjustment device 6 are shown, in accordance with at least some embodiments of the present disclosure. In particular, FIG. 4 shows a perspective view of the length adjustment device 6, while FIGS. 5 and 6 show front and side views, respectively, thereof. As shown, the length adjustment device 6 may include a body portion 10 having a channel 12 defined by a first wall 14 and a second wall 16 opposing the first wall. The body portion 10, the first and the second walls 14 and 16, respectively, in at least some embodiments, may form a substantially cylindrical or a tubular structure. Furthermore, in at least some embodiments, each of the first wall 14 and the second wall 16 may have an arcuate, or substantially arcuate, configuration with a lateral middle portion 18 that may be narrower (e.g., smaller diameter) in comparison with lateral end portions 20 flanking the lateral middle portion.

By virtue of the narrower lateral middle portion 18, the length adjustment device 6 may provide a mechanism to ensure that the cord 8 stays wrapped around the length adjustment device 6 during any exercise routine without coming undone. In other words, the shape and configuration of the length adjustment device 6 may dissuade the cord 8 from unwrapping and becoming disengaged from the length adjustment device. To further provide an anti-slip surface to the cord 8, an outer surface of one or more of the first wall 14, the second wall 16 and the body portion 10 may be provided with anti-slip coatings and coverings, such as, a rubber grip 22 (See FIG. 3). Moreover, in at least some embodiments, the length adjustment device 6 may be a constructed of an elastomeric material, such as, rubber, to further provide an anti-slip surface to the cord 8 and also to impart elasticity to the length adjustment device 6 for resisting various strains thereon that may be experienced during any exercise routine. In some other embodiments, the length adjustment device 6 may be constructed out of any rigid material, such as, plastic. Alternatively, a combination of an elastomeric and rigid material may be employed for constructing the length adjustment device 6.

Additionally, in at least some embodiments and, as shown, the first wall 14, the second wall 16, and the body portion 10 may all be constructed integrally in a single piece or, each of those pieces may be constructed separately and joined together in operational association. The length and width of the length adjustment device 6 may vary as well depending upon the length and width of the cord 8 desired to be wrapped around the length adjustment device. For example, in at least some embodiments, the length adjustment device 6 may be constructed to wrap around at least two feet of the cord 8. Notwithstanding the fact that in the present embodiment, the length adjustment device 6 has been described as having a specific shape (the narrower middle portion 18 flanked by the broader end portions 20) and configuration, it will be understood that several other shapes and configurations of the length adjusting device are contemplated and considered. Alternative configurations of the length adjustment device 6 are described below with respect to FIGS. 8-10.

Referring still to FIGS. 4-6, the channel 12 defined by the first wall 14, the second wall 16 opposing the first wall and the body portion 10 may be employed for receiving the cord 8 and wrapping the cord around the length adjustment device 6. Each of the first wall and the second wall 14 and 16, respectively, may additionally include a notch 24 extending laterally (e.g., at an angle to the channel 12) towards the body portion 10 from an edge of the first and the second walls. Each of the notches 24 may be employed for threading the cord 8 into and out of the length adjustment device 6, as described in greater detail below. In addition to threading the cord 8 to fix the length thereof, the notches 24 may permit axial loading of the cord without coming undone.

In at least some embodiments and, as shown in FIG. 5, a longitudinal axis 26 of the channel 12 may be formed substantially perpendicular to a longitudinal axis 28 of each of the notches 24. Furthermore, the longitudinal axis 28 of the notches 24 may be substantially parallel to one another. Moreover, the notches 24 may be formed on opposite ends of the first wall 14 and the second wall 16 and facing the channel 12. For example, one of the notches 24 may be formed on a top portion 30 of the first wall 14, while the other of the notches may be formed on a bottom portion 32 of the second wall 16, or vice versa. By virtue of providing the notches 24, each of the first and the second walls 14 and 16, respectively, may define an ear 34 for securing the cord 8 within the notches 24.

Figure 7:
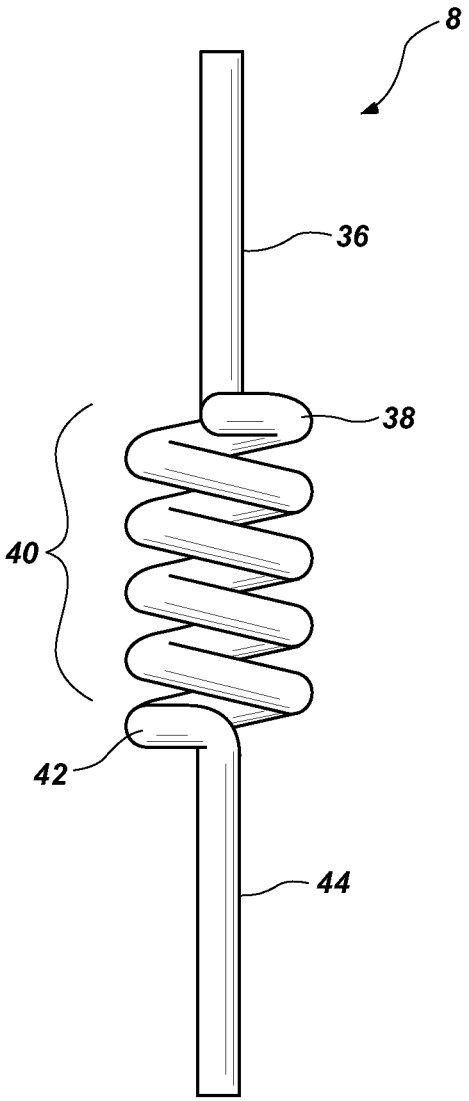
FIG. 7 shows a front view of the cord of FIG. 1.

Turning now to FIG. 7, an exemplary embodiment of the cord 8 and the manner of wrapping the cord around the length adjustment device 6 of FIGS. 4-6 is shown, in accordance with at least some embodiments of the present disclosure. As mentioned above, the cord 8 may be any of a variety of cords that may be employed in exercise routines, such as, a resistance band. In order to adjust the length of the cord 8, the cord may be threaded and wrapped around the length adjustment device 6, in a manner explained below. Specifically and, referring to FIG. 7 in conjunction with FIGS. 2 and 3 above, any one end 36 of the cord 8 may first be positioned within the channel 12 and then that end may be threaded in through one of the notches 24. Threading in of the end 36 of the cord 8 may be accomplished by turning that end ninety degrees (or substantially ninety degrees) from the channel 12 and through one of the notches 24 towards an outer surface of the length adjustment device 6, as illustrated by cord portion 38. Subsequent to threading the end 36 through the one of the notches 24, that end may be pulled and a portion 40 of the cord 8 may be wrapped circumferentially into coils around the outer surface of the first wall 14, the second wall 16 and the body portion 10.

The portion 40 of the cord 8 or the number of coils of the cord to be wrapped around the length adjustment device 6 may depend upon the desired effective length of the cord. After wrapping the cord 8 circumferentially around the length adjustment device 6 to the desired length, the cord 8 may be threaded out through another one of the notches 24. Specifically, to thread out the cord 8 through one of the notches 24, the end of the cord after wrapping about the length adjustment device 6 may be received from the outer surface of the length adjustment device into one of the other of the notches and then it may be turned substantially ninety degrees into the channel 12 and out of the length adjustment device 6, as shown by cord portion 42.

By virtue of threading the cord 8 through the notches 24 and wrapping the cord about the first and the second walls 16 and 10, respectively, and the body portion 10, in a manner described above, the length of the cord may be appropriately adjusted. Upon wrapping the cord 8 through the length adjustment device 6, the end 36 along with end 44 of the cord 8 may be employed for performing any of a variety of exercises such as those mentioned above. The ears 34 formed by the notches 24 permit the application of axial force and stress on the cord 8 without the cord becoming disengaged from the length adjustment device 6 after engagement with the notches 24.

Upon wrapping the cord 8 around the length adjustment device 6, the length of the cord may be re-adjusted by unthreading one of the ends 36 or 44 from their respective notches 24, wrapping or un-wrapping one or more coils of the cord around the first wall 14, the second wall 16 and the body portion 10, and re-threading that end through its respective notch.

Figure 8:
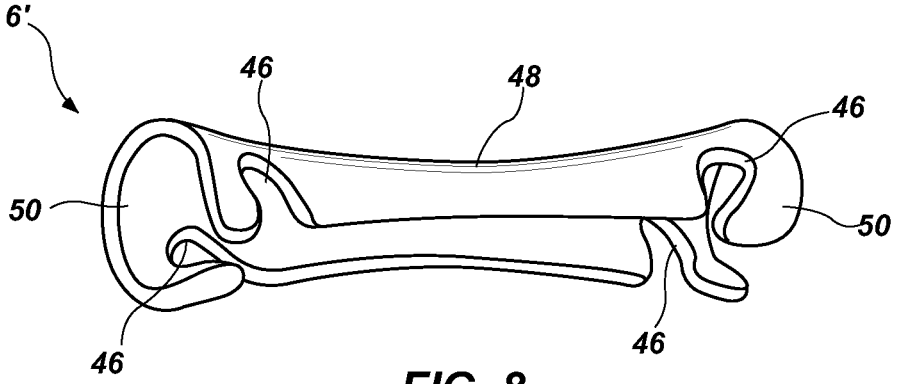
FIG. 8 is a perspective view of another exemplary embodiment of a length adjusting device constructed in accordance with the teachings of the present disclosure.
Figure 9:
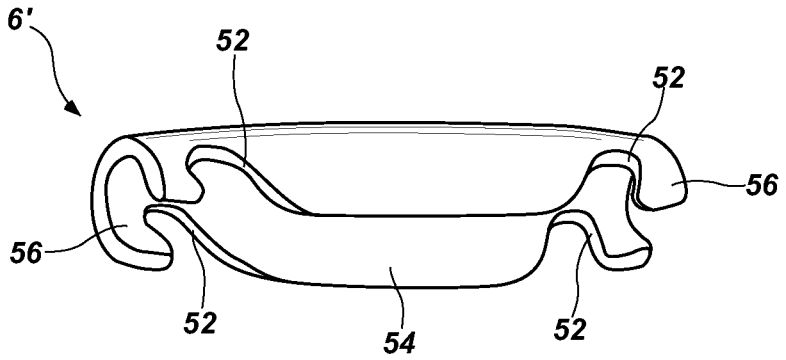
FIG. 9 is a perspective view of yet another exemplary embodiment of a length adjusting device constructed in accordance with the teachings of the present disclosure.
Figure 10:
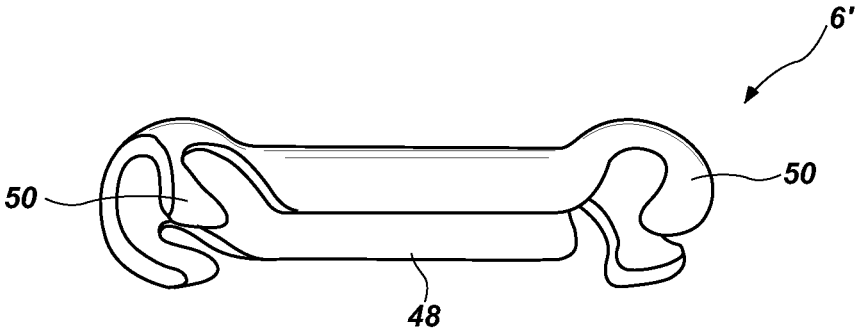
FIG. 10 is a perspective view of another exemplary embodiment of a length adjusting device constructed in accordance with the teachings of the present disclosure.

Referring now to FIGS. 8-10, alternate embodiments 6' of the length adjustment device 6 are shown. With respect to FIG. 8 in particular, in contrast to the length adjustment device 6 of FIGS. 4-6 above in which only one of the notches 24 is present on each of the first wall and the second wall 14 and 16, respectively, the length adjusting device 6' of FIG. 8 has a pair of notches 46 on each of the first wall and the second wall. However, similar to the length adjustment device 6, the length adjusting device 6' may also include a narrower middle portion 48 and flanked on both ends by broader end portions 50.

Relatedly, the length adjusting device 6' of FIG. 9 may include a pair of notches 52 on each of the first and the second walls 14 and 16, respectively, with each of the notches being wider than the notches 24 and 46. The wider notches 52 may in part be formed by a broader middle portion 54 that may be broader (e.g., larger diameter) than end portions 56 flanking thereof. The length adjusting device 6' of FIG. 10 on the other hand may be similar to the length adjusting device 6' of FIG. 8 with the exception that the end portions 50 may be substantially bulbous with a considerably larger diameter than the middle portion 48, which in at least some embodiments may not be arcuate.

Figure 11:
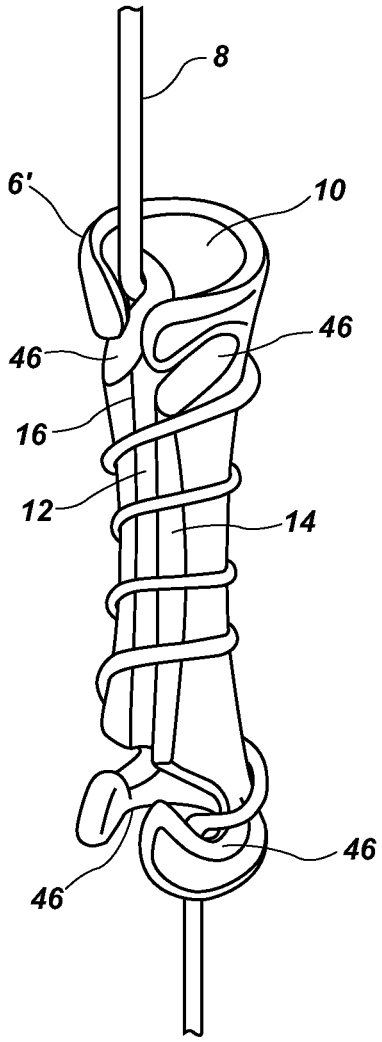
FIG. 11 is a perspective view of the length adjustment device of FIG. 8, with a cord wrapped there around.

Referring now to FIG. 11, a mechanism for adjusting the length of the cord 8 using one of the length adjustment devices 6' of FIGS. 8-10 is shown, in accordance with at least some embodiments of the present disclosure. Specifically, FIG. 11 shows the length adjustment device 6' of FIG. 8 with the cord 8 wrapped there around. Notwithstanding the fact that only the manner of wrapping the cord 8 around the length adjustment device 6' of FIG. 8 is shown in FIG. 11, it will be understood that a similar procedure for wrapping the cord around the length adjustment devices 6' of FIGS. 10 and 11 can be employed as well.

As shown and, similar to the mechanism illustrated in FIG. 7, the cord 8 may be wrapped around the length adjustment device 6' by utilizing a pair of opposing notches. For example, the notch 46 in the top (or bottom) portion of the first wall 14 and the opposing notch 46 in the bottom (or top) portion of the second wall 16 may be utilized for threading and wrapping the cord 8 around the length adjustment device 6'. In particular, one end of the cord 8 may be positioned within the channel 12, then it may be turned ninety (or substantially ninety) degrees from the channel through one of the notches 46 towards an outer surface of the length adjustment device 6', the threaded in cord may be wrapped circumferentially about the length adjustment device and then it may be threaded out. The cord 8 may be threaded out by receiving the cord into the other of the notches 46 and turning the cord substantially ninety degrees into the channel 12 and out of the length adjustment device 6'.

Industrial Applicability

In general, the present disclosure sets forth a length adjustment device that may be employed to vary and adjust the length of an exercise cord. In at least some other embodiments, the length adjustment device may be used with any type of rigid or flexible cords, ropes, or tubing to adjust the usable length of the cord while preventing slippage of the cord. To facilitate length adjustment of the cord, the length adjustment device may include a first wall, an opposing second wall and a body portion defining a channel therethrough. The first wall and the second wall may each additionally include at least one notch defining a ear for threading in and threading out the cord.

By virtue of utilizing the length adjustment device and adjusting the length of the cord using the length adjustment device, a variety of lengths to perform a variety of exercises using a single cord (e.g. resistance band) may be obtained, thereby avoiding the need to own multiple bands for different kinds of exercises. Furthermore, the length adjustment device circumvents the problem of determining the right length of the resistance band to purchase for one's height for performing resistance band exercises by providing a mechanism to purchase, for example, the biggest available length of the resistance band and varying the length thereof by using the length adjustment device. In addition, a single resistance band may be shared by multiple people of varying heights by merely varying the length (by the length adjusting device) of the resistance band suitable for the user's height.

Moreover, the length adjustment device is compact, lightweight and portable. A variety of exercises, such as, resistance push-ups, squats, lunges, shrugs, kickbacks, crunches, various types of curls, etc., may be easily performed by utilizing the length adjustment device by merely varying the length of the resistance band to an optimal length suitable for that group of exercise. Again, although the above disclosure has been described with respect to using the length adjustment device for resistance bands, it is an intention of this invention to utilize the length adjustment device for any application that would require varying the lengths of a cord.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A device for adjusting a length of a cord, the device comprising:

a tubular body portion having a through channel that extends from a first end portion of the tubular body to a second end portion of the tubular body, wherein a length of the through channel is defined by edges of first and second opposed walls shaped to receive a cord, the edges of each of the first wall and the second wall defining at least one notch in each of the first and second walls shaped to receive the cord in a direction provided at an angle to the channel; and wherein the through channel includes a channel longitudinal axis and each of the at least one notch includes a notch longitudinal axis, the channel longitudinal axis being substantially perpendicular to each of the notch longitudinal axes.

2. The device of claim 1, wherein the first wall and the second wall each include at least one ear defining the at least one notch in each first and second walls.

3. The device of claim 2, wherein the first wall and the second wall each include a pair of ears.

4. The device of claim 1, wherein the device includes a smallest diameter at a lateral center and a largest diameter at first and second ends flanking the lateral center.

5. The device of claim 1, wherein the first wall, the second wall and the tubular body portion are integrally formed.

6. The device of claim 1, wherein the at least one notch in the first wall and the at least one notch in the second wall are substantially parallel.

7. The device of claim 1, wherein the first wall, the second wall and the tubular body portion are elastic.

8. The device of claim 1, wherein the first wall, the second wall and the tubular body portion are rigid.

9. The device of claim 1, wherein the cord is an exercise resistance band.

10. A method for adjusting a length of a resistance band, the method comprising:

providing a resistance band and a length adjustment device, the length adjustment device having a tubular body with a through channel extending from a first end portion of the tubular body to a second end portion of the tubular body, wherein a length of the through channel is defined by edges of first and second opposed walls, each of the first wall and the second wall also defining at least one notch in each of the first and second walls, respectively;

threading in one end of the resistance band through one of the at least one notch;

wrapping a portion of the threaded resistance band around the length adjustment device; and threading out the resistance band through the other of the at least one notch;

wherein the through channel includes a channel longitudinal axis and each of the at least one notch includes a notch longitudinal axis, the channel longitudinal axis being substantially perpendicular to each of the notch longitudinal axes.

11. The method of claim 10, wherein each of the at least one notch forms ears in the length adjustment device, the resistance band engaging the ears so as to permit axial loading of the resistance band without disengaging the band from the length adjustment device.

12. The method of claim 10, wherein the length adjustment device permits wrapping at least two feet of the resistance band around the length adjustment device.

13. The method of claim 10, wherein threading in the resistance band through one of the at least one notch comprises:

positioning one end of the resistance band into the channel; and turning the one end of the resistance band from the channel substantially ninety degrees into one of the at least one notch.

14. The method of claim 10, wherein threading out the resistance band comprises:

wrapping a first coil of the resistance band circumferentially around the length adjustment device and into the other of the at least one notch; and turning the resistance band from the other of the at least one notch substantially ninety degrees to fix the length of the resistance band.

15. The method of claim 10, wherein adjusting the length of the resistance band comprises:

unthreading one end of the resistance band from one of at least one notch;

wrapping or unwrapping one or more coils of the resistance band around the length adjustment device; and rethreading the resistance band through the one of the at least one notch.

16. An exercise device for facilitating resistance band exercises, the exercise device comprising:

a length adjustment device having a tubular body portion with a length of a through channel defined by edges of a first wall and a second wall, each of the first wall and the second wall defining at least one notch in each of the first and second walls provided at an angle, wherein the device includes a smallest diameter at a lateral center and a largest diameter at first and second ends flanking the lateral center; and a resistance band adapted to be engaged relative to the length adjustment device and secured at various lengths thereof;

wherein the through channel includes a channel longitudinal axis and each of the at least one notch includes a notch longitudinal axis, the channel longitudinal axis being substantially perpendicular to each of the notch longitudinal axes.

17. The exercise device of claim 16, wherein the first wall and the second wall each include a pair of ears.

18. The exercise device of claim 16, wherein the length of the resistance band is adjusted by wrapping the resistance band around the length adjustment device a desired number of coils and securing the resistance band through the at least one notch.

19. The exercise device of claim 16, wherein the at least one notch in the first wall and the at least one notch in the second wall are substantially parallel.

* * * * *